US010197332B2

(12) United States Patent
Hinkey

(10) Patent No.: US 10,197,332 B2
(45) Date of Patent: Feb. 5, 2019

(54) APPAREL DRYING ASSEMBLIES AND METHODS OF DRYING APPAREL

(71) Applicant: Lawrence A. Hinkey, Glens Falls, NY (US)

(72) Inventor: Lawrence A. Hinkey, Glens Falls, NY (US)

( * ) Notice: Subject to any disclaimer, the term of this patent is extended or adjusted under 35 U.S.C. 154(b) by 277 days.

(21) Appl. No.: 15/195,250

(22) Filed: Jun. 28, 2016

(65) Prior Publication Data

US 2017/0370647 A1 Dec. 28, 2017

(51) Int. Cl.

| | |
|---|---|
| ***F26B 21/00*** | (2006.01) |
| ***A47L 23/20*** | (2006.01) |
| ***D06F 59/04*** | (2006.01) |
| ***F26B 3/02*** | (2006.01) |
| ***F26B 9/10*** | (2006.01) |

(Continued)

(52) U.S. Cl.

CPC ..... *F26B 21/006* (2013.01); *A43D 95/10* (2013.01); *A47L 23/205* (2013.01); *D06F 59/04* (2013.01); *D06F 59/06* (2013.01); *F26B 3/02* (2013.01); *F26B 9/10* (2013.01)

(58) Field of Classification Search

CPC . F26B 21/006; F26B 3/02; F26B 9/10; A43D 95/10; A47L 23/205; D06F 59/04; D06F 59/06

USPC ..... 34/427, 90

See application file for complete search history.

(56) References Cited

U.S. PATENT DOCUMENTS 1,074,888 A * 10/1913 McIver ..... F26B 21/006 12/123
2,443,695 A 6/1948 Russell
2,668,368 A 12/1952 Jacobs (Continued)

FOREIGN PATENT DOCUMENTS

CA 2801681 A1 * 7/2013 ..... F26B 25/08
DE 2852762 A1 6/1980

(Continued)

OTHER PUBLICATIONS

Wiliams Boot Dryers. Datasheet [online]. Williams, date unknown. [retrieved on Feb. 22, 2018] Retrieved from the Internet: <URL: http://www.seaproductsonline.com/WilliamsBootDryers.htmll>.

(Continued)

*Primary Examiner* — Stephen M Gravini

(74) *Attorney, Agent, or Firm* — Tech Valley Patent, LLC; John Pietrangelo

(57) ABSTRACT

Assemblies and methods for drying apparel, for example, footwear or gloves, are provided. The assemblies include a panel; projections or pegs pivotally mounted to the panel, the projections each having an inlet, an outlet, an internal passage communicating the inlet to the outlet, and the projections can be oriented in a position adapted to receive the apparel; and a source of air having an outlet in fluid communication with the inlets of the projections. The air, for example, from a fan, passes into the inlets of the projections, through the internal passages, and out of the outlets to contact and dry the apparel mounted on the projections. The methods may include heating the air to enhance the drying. Projection modules that can be pivotally mounted to extend and retract into the panel are also disclosed. The retracted projection may be flush with the panel when not in use.

19 Claims, 8 Drawing Sheets

(51) Int. Cl.

| | |
|---|---|
| ***A43D 95/10*** | (2006.01) |
| ***D06F 59/06*** | (2006.01) |

(56) References Cited

U.S. PATENT DOCUMENTS

| | | | | | |
|---|---|---|---|---|---|
| 2,835,049 | A | | 5/1958 | Jacobs | |
| 3,626,602 | A | * | 12/1971 | Glowacki | D06F 57/04 34/232 |
| 3,793,744 | A | | 2/1974 | Saita | |
| 3,798,788 | A | | 3/1974 | Kuntz | |
| 4,145,602 | A | | 3/1979 | Lee | |
| 4,200,993 | A | | 5/1980 | Blanc et al. | |
| 4,727,656 | A | | 3/1988 | Jannach et al. | |
| 4,856,206 | A | * | 8/1989 | Klein | D06F 57/12 219/386 |
| 4,887,153 | A | | 12/1989 | Uehara et al. | |
| D310,742 | S | | 9/1990 | Johnson | |
| 5,199,188 | A | | 4/1993 | Franz | |
| 5,222,308 | A | | 6/1993 | Barker et al. | |
| 5,287,636 | A | | 2/1994 | Lafleur et al. | |
| 5,394,619 | A | | 3/1995 | Kaplan | |
| 5,412,928 | A | | 5/1995 | Reithel | |
| 5,642,462 | A | | 6/1997 | Huff | |
| 5,778,556 | A | * | 7/1998 | Ohsugi | A43D 3/1408 211/34 |
| 5,894,680 | A | * | 4/1999 | Dalvy | A43B 7/28 34/104 |
| 5,987,773 | A | | 11/1999 | Lipscy | |
| 6,698,106 | B1 | | 3/2004 | Reithel et al. | |
| 6,766,591 | B1 | | 7/2004 | McKinney et al. | |
| 8,322,541 | B2 | | 12/2012 | Maclaren-Taylor | |
| 8,857,072 | B1 | | 10/2014 | Cocker et al. | |
| 8,984,766 | B2 | * | 3/2015 | Williams | F26B 20/00 34/381 |
| 9,609,970 | B2 | * | 4/2017 | Piraino | A47G 25/4053 |
| 2005/0204579 | A1 | | 9/2005 | Rosseau et al. | |
| 2010/0031526 | A1 | | 11/2010 | Tuckett | |
| 2013/0008045 | A1 | | 1/2013 | McLoughlin et al. | |
| 2013/0199581 | A1 | * | 8/2013 | Christopherson | B08B 5/026 134/103.2 |
| 2017/0370647 | A1 | * | 12/2017 | Hinkey | A47L 23/205 |
| 2018/0105972 | A1 | * | 4/2018 | Smoots | D06F 59/04 |

FOREIGN PATENT DOCUMENTS

| | | | |
|---|---|---|---|
| DE | 20215507 | U1 | 3/2003 |
| DE | 20215507 | U1 | 6/2003 |
| EP | 180530 | A1 | 5/1986 |
| FR | 2199452 | A1 | 4/1974 |
| WO | 2006082487 | A1 | 1/2006 |

OTHER PUBLICATIONS

GearDryer Boot Dryers. Datasheet [online]. GearDryer, date unknown. [retrieved on Feb. 22, 2018] Retrieved from the Internet: <URL: http://www.seaproductsonline.com/GearDryer.html>.

Wintersteiger Boot Dryers. Datasheet [online]. Wintersteiger, date unknown. [retrieved on Feb. 22, 2018] Retrieved from the Internet: <URL: https://www.wintersteiger.com/us/Drying-and-Hygienic/Products/Product-Range/Open-drying-systems-in-steel-Boot-dryer-glove-dryer/206-Boot-51020I>.

International Search Report from corresponding PCT application PCT/US2017/039501, dated Aug. 6, 2017, 4 pages.

Written Opinion from corresponding PCT application PCT/US2017/039501, dated Aug. 6, 2017, 8 pages.

Seha, Patrick, "Piano Coat Rack," 2pp., Brochure [online]. Seha, date unknown. [retrieved on Jun. 28, 2016] Retrieved from the Internet: <URL: https://www.smow.de/pdf/PerUse_Piano_1.pdf>.

BK Blower Manual, 108998-01, Rev. F, 8pp, Feb. 2007.

Cyclone boot dryers, 3pp., Brochure [online].Cyclone, date unknown. [retrieved on Jun. 21, 2016] Retrieved from the Internet: <URL: http://www.cyclonebootdryers.com>.

Cozywinters boot dryers, 4pp., Brochure [online]. Cozywinters, date unknown. [retrieved on Jun. 21, 2016] Retrieved from the Internet: <URL: http://cozywinters.com/boot-dryers.html>.

* cited by examiner

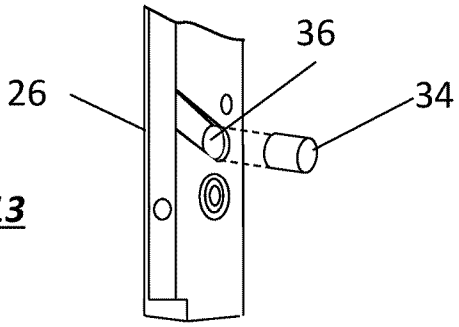
Figure 13
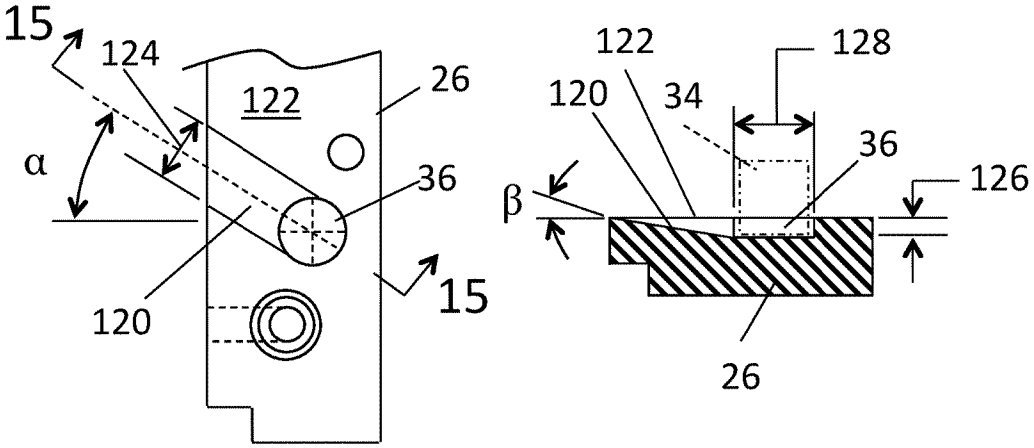
Figure 14
Figure 15
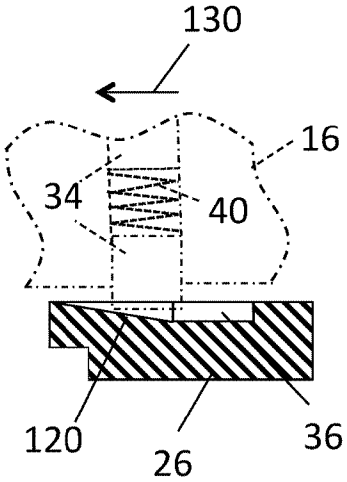
Figure 16

APPAREL DRYING ASSEMBLIES AND METHODS OF DRYING APPAREL

BACKGROUND OF THE INVENTION

Technical Field

The present invention concerns apparel drying, for example, the drying of footwear and hand wear. Specifically, aspects of the invention provide drying assemblies and methods employing wall-mounted panels having pivotally mounted projections adapted to emit a flow of drying air to apparel hung on the projections.

Description of Related Art

Wet clothing, especially, wet footwear, is a common irritation and inconvenience to most, in particular to mothers and skiers. Waiting for footwear or clothing to dry for re-use or storage can hamper outdoor activity or prevent timely access to recreational opportunities and commercial enterprises. Accordingly, many attempts have been made in the art to facilitate the drying of apparel. However, prior art attempts have typically included cumbersome devices and methods that, for example, do not lend themselves to the décor or environment typically desired in a home, office, or resort.

For example, U.S. Pat. No. 3,793,744 discloses a wall-mounted rack for drying shoes having conduits and rigidly mounted extensions for distributing air. U.S. Pat. No. 4,200,993 discloses a tower for drying ski boots having a vertical plenum and rigidly mounted tubes projecting from the plenum for distributing air to the boots. U.S. Pat. No. 5,287,636 discloses a shoe dryer having pivoting tubes that are inserted into the shoes to distribute hot air. PCT Publication WO 2006/082487 discloses a wall-mounted boot dryer having projections that rotate when loaded to contact a switch which activates a heating element in the projection. German patent DE 20215507 discloses a heating rack having vertical tubes and horizontal tubes carrying heated water with projecting tubes for hanging articles.

In addition, numerous boot-drying devices are presented online, for example, the "Cyclone" boot dryer disclosed at www.cyclonedryers.com and several portable boot dryers at http://cozywinters.com/boot-dryers.html, among others.

However, these and other devices and methods lack the convenience, appearance, and utility of aspects of the present invention.

SUMMARY OF THE INVENTION

The present invention, in its many embodiments and aspects, was inspired by an existing coat rack. Specifically, the "Piano Coat Rack" designed and offered by Patrick Seha, a Belgian furniture designer. Though somewhat similar in appearance to the Seha coat rack, the present invention includes a wall-mounted rack/panel for drying apparel, such as, footwear and gloves. The panel includes retractable hooks or pegs upon which apparel can be hung. The pegs are hollow and perforated and fed by drying air, for example, heated drying air. The retractable pegs pivotally mount to the panel and engage an air distribution system, and, when extended, the pegs may engage the source of drying air. When not in use, the retractable pegs are retracted into the panel to, for example, provide an aesthetically appealing wall decoration.

One embodiment of the invention is an apparel drying assembly comprising or including: a panel; a projection, or a "peg," mounted to the panel, the projection having an inlet, at least one outlet, an internal passage communicating the inlet to the at least one outlet, and the projection oriented in to at least one position adapted to receive an apparel; and a source of pressurized air having an outlet in fluid communication with the inlet of the projection; wherein the pressurized air passes into the inlet of the projection, through the internal passage, and out of the at least one outlet to contact and at least partially dry the apparel received by the projection. In one aspect, the projection, or one or more projections, can be pivotally mounted to the panel. In one aspect, the pivotally mounted projection may have at least one first position extending from the panel, and a second, retracted position. When the projection is positioned in the second, retracted position, a surface of the projection can be substantially coplanar with a surface of the panel.

In another aspect, the drying assembly may further include one or more projection modules mounted to the panel, where one or more of the projection modules contain the projections. In one aspect, the projection module comprises a plurality of passages, for example, the passages having an inlet in fluid communication with the outlet of the source of pressurized air.

In one aspect, the drying assembly may also include a heater adapted to heat the pressurized air.

Another embodiment of the invention is a method of drying apparel. The method of drying apparel comprises or includes: pivotally mounting a projection to a panel, the projection having an inlet, at least one outlet, and an internal passage communicating the inlet to the at least one outlet; providing a source of pressurized air having an outlet operatively connected to the inlet; mounting an apparel on to the projection; passing the pressurized air to the inlet of the projection, through the internal passage, and out of the at least one outlet; and contacting the air discharged from the at least one outlet upon the apparel to at least partially dry the apparel.

In one aspect, the step of mounting a projection module to the panel, wherein the projection is pivotally mounted to the projection module, may comprise the practice of pivotally mounting the projection to the panel.

In another aspect, the method may further include rotating the pivotally mounted projection from a retracted position to an extended position. In another aspect, the method may include heating the pressurized air.

In one aspect, the apparel may be footwear or hand wear.

A further embodiment of the invention is an apparel drying projection module comprising or including: a housing; and a projection mounted to the housing, the projection having an inlet, at least one outlet, an internal passage communicating the inlet to the at least one outlet, and the projection oriented in to at least one position adapted to receive an apparel. In one aspect, the housing may include a pair of side elements and an internal element positioned between the side elements. In another aspect, the housing may include passages in fluid communication with the inlet of the projection and in fluid communication with a source of pressurized air. In one aspect, the module may be substantially completely made of wood, for example, a decorative hardwood.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

FIG. 13 is an exploded perspective view of a portion of a side element and a pin of a projection assembly according to one aspect of the invention.

FIG. 14 is a plan view of the portion of the side element shown in FIG. 13.

FIG. 15 is a cross-sectional view of the portion of the side element shown in FIG. 14 as viewed along section lines 15-15 in FIG. 14.

FIG. 16 is a cross-sectional view, similar to FIG. 15, of the portion of the side element shown in FIG. 15 showing the relative movement of a mounting pin.

DETAILED DESCRIPTION OF THE INVENTION

Figure 2:
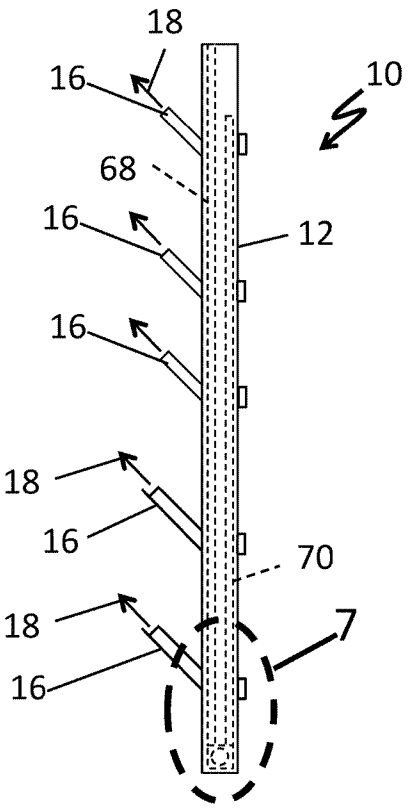
FIG. 2 is a side elevation view of the apparel drying assembly shown in FIG. 1.
Figure 1:
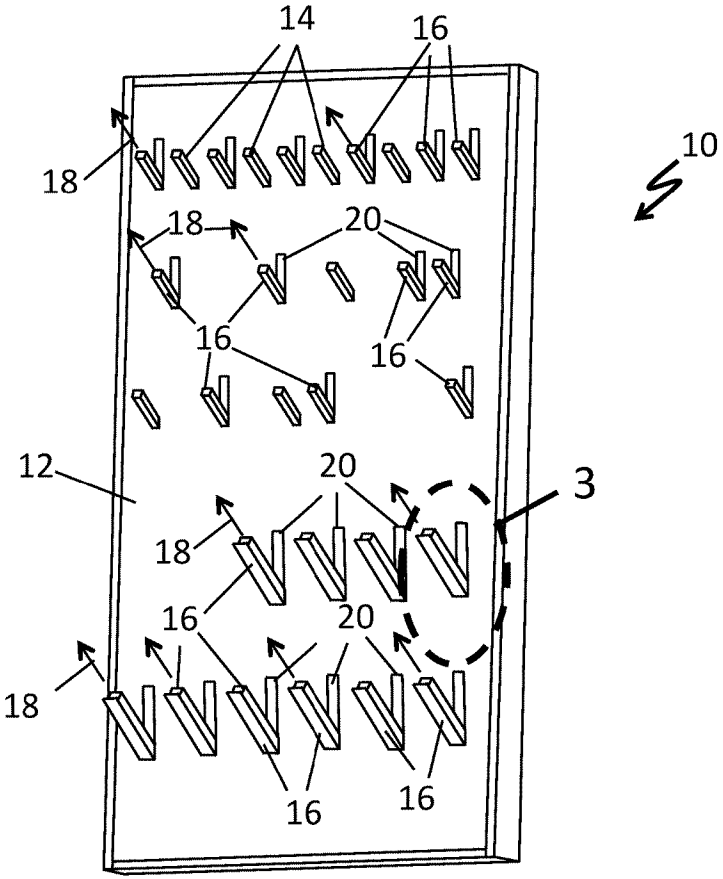
FIG. 1 is a perspective view of an apparel drying assembly according to one aspect of the invention.

FIG. 1 is a perspective view of an apparel drying assembly 10 according to one aspect of the invention. FIG. 2 is a side elevation view of the apparel drying assembly 10 shown in FIG. 1. As shown, assembly 10 typically includes a panel or board 12 having an arrangement of projections 14, or "pegs," positioned and adapted to receive an article of clothing (not shown), for example, a hat, a coat, a jacket, shoes, boots, gloves, and the like. In addition to or in lieu of projections 14, assembly 10 typically includes at least one, but typically a plurality, of projections 16 adapted to receive an article of clothing (not shown), but also adapted to discharge a flow of air 18, for example, a heated flow of air, to at least partially evaporate moisture from, for example, "to dry," an article of clothing while the article is mounted to a projection 16 of assembly 10. As also shown in FIG. 1, according to one aspect of the invention, panel 12 of assembly 10 may also include one or more cavities or recesses 20 into which projections 16 may be adapted to retract into, for example, pivotally rotate into.

Figure 4:
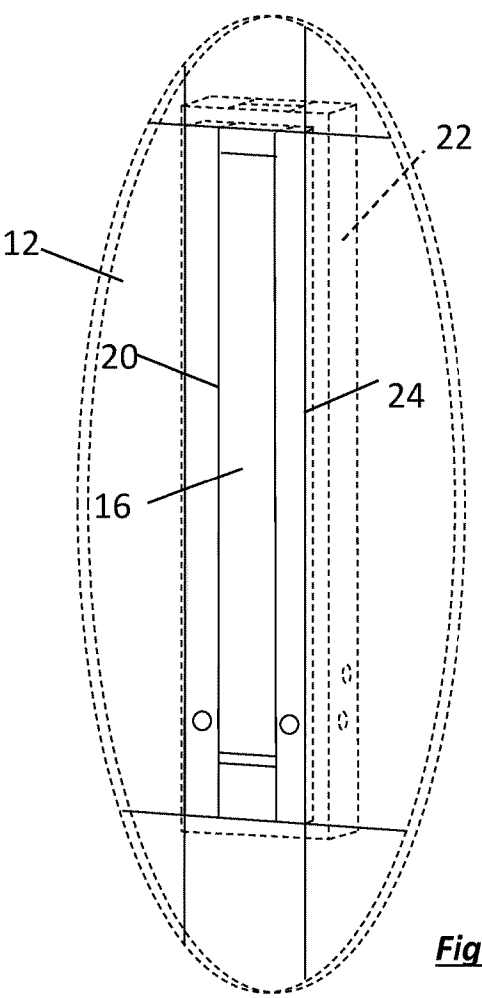
FIG. 4 is a perspective view, similar to FIG. 3, of the detail shown in FIG. 3, with the projection in a retracted position.
Figure 3:
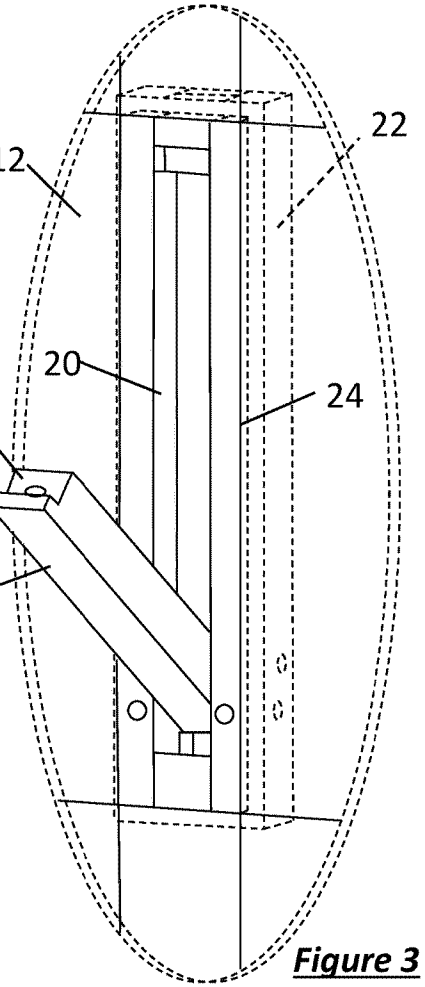
FIG. 3 is a perspective view of a detail of the apparel drying assembly shown in FIG. 1, as identified by Detail 3 in FIG. 1, with the projection in an extended position.

FIG. 3 is a perspective view of a detail of the apparel drying assembly to shown in FIG. 1, as identified by Detail 3 in FIG. 1, with the projection or peg 16 in an extended position, for example, pivotally rotated out of cavity 20. FIG. 4 is a perspective view of the Detail 3 shown in FIG. 3, with the projection 16 in a retracted position, for example, pivotally rotated into cavity 20. As shown in FIGS. 3 and 4, in one aspect, projection 16 and cavity 20 may be provided as a subassembly, assembly, or projection module 22 mounted in panel 12, for example, mounted in a hole 24 in panel 12, though other methods of providing projection 16 and recess 20 in panel 12 are envisioned and will be apparent to those of skill in the art. In the aspect shown in FIGS. 3 and 4, hole 24 in panel 12 is a rectangular hole having a substantially vertical long axes, the hole 24 is sized and positioned to accept module 22, though it is envisioned that module 22 and hole 24 may assume different shapes and/or orientations.

Figure 3A:
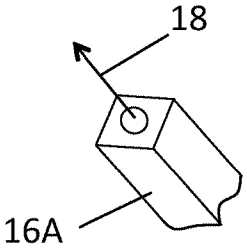
FIG. 3A is a perspective view of the distal end of an alternative projection according an aspect of the invention.

FIG. 3A is perspective view of the distal end of an alternative projection 16A that may be used in projection module 22 shown in FIGS. 3 and 4 according an aspect of the invention. In contrast to projection 16 shown in FIG. 3, the distal end of projection 16A may be devoid of a lip or projection (see reference number 39 in FIG. 6). According to one aspect of the invention, the lip of projection 16 may be provided to uniquely adapt to accommodate an extractable drying tube (for example, as shown and described with respect to FIGS. 11 and 12).

Figure 6:
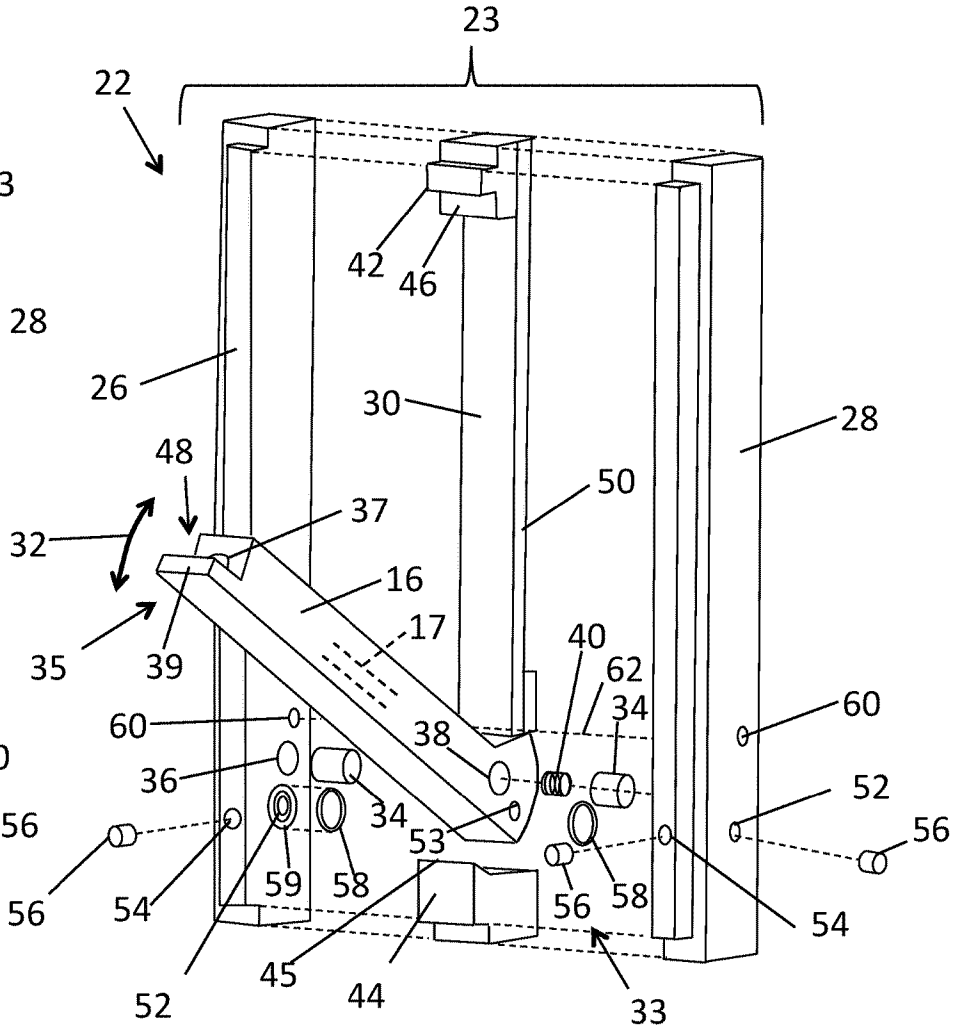
FIG. 6 is an exploded perspective view of the projection module shown in FIG. 5.
Figure 5:
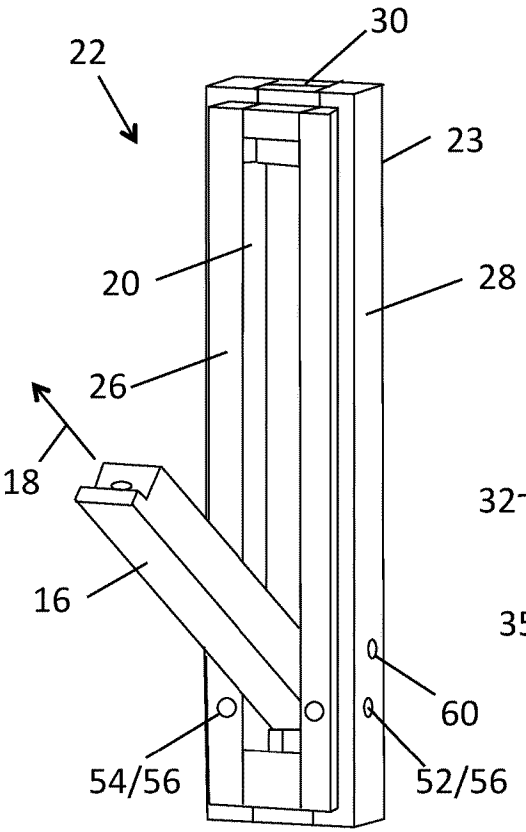
FIG. 5 is a perspective view of the projection module shown in FIG. 3.

FIG. 5 is a perspective view of the projection module 22 shown in FIGS. 3 and 4, and FIG. 6 is an exploded perspective view of the projection module 22 shown in FIG. 5. In the aspect shown in FIGS. 5 and 6, module 22 is fabricated from individual components and assembled into an integral module. The components of module 22 may be fabricated from any convenient material, for example, from a metal, from a plastic, or from wood. In one aspect, as shown in FIGS. 5 and 6, and described herein for the sake of illustration, the components of module 22 are described and illustrated as being predominantly fabricated from wood, for example, a decorative hardwood.

As most clearly shown in FIGS. 5 and 6, module 22 includes a housing 23 containing the projection 16. Housing 23 may comprise or include a pair of opposing side elements 26 and 28 which "sandwich," for example, are positioned about, an internal element 30. As shown in FIG. 6, in one aspect, projection 16 is also "sandwiched," between elements 26 and 28, and may be pivotally mounted to elements 26, 28, or both, as indicated by doubled-headed curved arrow 32. For example, in one aspect, projection 16 may be pivotally mounted at a proximal end 33 and have a distal end 35 having a hole 37 positioned and adapted to emit a flow of gas, such as forced or pressurized air. In one aspect, distal end 35 may include a lip or projection 39 adapted to engage internal element 30 when retracted and/or to conceal an extractable tube (see FIGS. 11 and 12).

In one aspect, the proximal end 33 of projection 16 may be pivotally mounted to module 22, for example, to one or both of elements 26 and 28, via one or more pins, pegs, or dowel pins 34. One or more pins 34 may be mounted in elements 26 and 28, for example, positioned in blind holes 36 (only one of which is shown in FIG. 6) in elements 26 and 28 and pins 34 may be inserted into and rotate with respect to blind or through hole 38 in projection 16. In another aspect, one or more pins 34 may be mounted in projection 16, for example, positioned in blind or through holes 38 (only one of which is shown in FIG. 6) and pins 34 may be inserted into and rotate with respect to blind or through hole 36 in elements 26 and 28. Other methods of pivotally mounting projection 16 to elements 26 and 28 are also within the purview of the present invention and will be apparent to those of skill in the art.

In one aspect, the pivotal mounting of projection 16 in module 22 may bias the position of or orientation of projection 16 in module 22. For exampled, in one aspect, the pivotal mounting of projection 16 may be biased by one or more springs or resilient materials, such as, elastomers or rubber materials. In the aspect of the invention shown in FIG. 6, the orientation of projection 16 may be biased by one or more coil springs 40, for example, inserted into hole 38 and appropriately adapted to engage and bias the position of projection 16. For instance, spring 40 may include extensions from the coil of the spring, for example, radially directed extensions that engage one or more recesses in hole 38 and/or in projection 16. In another aspect, one or more springs or elastomeric materials may bias the axial position of pins 34, for example, a coil spring 40 may bias pins 34 into axial engagement with holes 36 in elements 26 and 28. This biased axial engagement may provide for the manual engagement or disengagement of projection 16 from elements 26 and 28, for example, as "pushable" pins, for instance, for facilitating assembly, disassembly, maintenance, and/or repair of module 22.

In one aspect, module 22 may include one or more "stops" or restrictions that limit the rotation of projection 16. For example, as shown in FIGS. 5 and 6, internal element 30 of module 22 may include an upper stop 42 and a lower stop 44 positioned and sized to limit or impede the travel of projection 16. Upper stop 42 and lower stop 44 may be integrally mounted to internal element 30, or comprise distinct, separate components. Upper stop 42 may provide a surface 46 positioned to contact and limit the travel of projection 16, for example, surface 46 may be shaped and positioned to contact a surface of projection 16, for example, the face 48 of lip 39. In a preferred, but non-limiting, aspect, upper stop 42 and the distal end 35 of projection 16 may be sized and shaped wherein, when retracted (see FIG. 4), the external surface of projection 16 is substantially co-planar with the surfaces of elements 26 and 28 and/or the surface of panel 12 (see FIGS. 3 and 4), for instance, the surfaces of projection 16 and elements 26 and 28 may be substantially "flush" with each other.

Lower stop 44 may provide a surface 45 positioned to contact and limit the travel of projection 16, for example, surface 45 mat be shaped and positioned to contact a surface of projection 16. In a preferred, but non-limiting, aspect, lower stop 44 and the proximal end 33 of projection 16 may be sized and shaped wherein, when retracted (see FIG. 4), the external surface of projection 16 is substantially co-planar with the surfaces of elements 26 and 28 and/or panel 12, for instance, the surfaces of projection 16 and elements 26 and 28 are substantially "flush" with each other.

Upper stop 42 and/or lower stop 44 may be mounted on a common spine 50 of internal element 30 which may extend between upper stop 42 and lower stop 44.

According to aspects of the invention, projection module 22 may typically include a network of passages adapted to transmit air, for example, from a source of pressurized air, to projection 16 to be emitted to an article of apparel as indicted by arrow 18 in FIG. 5. As shown in FIG. 6, projection 16 may have one or more openings or orifices 37, for example, at the distal end 35, which is in fluid communication with one or more internal passages 17 in projection 16. Though in one aspect of the invention a single opening 37 and a single internal passage 17 may be provided in projection 16, it is envisioned that 2 or more openings 37 in fluid commination with one or more internal passages 17 may be provided. The two or more openings 37 may be directed axially and/or transversely (for example, radially) from projection 16. According to aspects of the invention, the internal passage 17 of projection 16 may be in fluid communication with fluid passages in any one or more of side elements 26 and/or 28, and/or internal element 30. Internal passage 17 may have any desired cross-section, though in one aspect a circular passage is preferred. The internal diameter of a circular internal passage 17 may range from about 0.125 inches to about 2 inches, depending, among other things, upon the size of projection 16. However, typically, internal passage 17 may have a diameter ranging from about 0.25 inches to about 0.75 inches, for example, about 0.5 inches.

Though many different sized and located passages may be provided inside elements 26 and 28 and internal element 30, in the aspect of the invention shown in FIGS. 5 and 6, side elements 26 and 28 may have passages defined by holes 52 and 54, for example, through holes or blind holes. Holes 52 and 54 may typically be plugged as needed by inserting plugs 56, for example, a press fit and/or with an adhesive. According to one aspect, holes 52 and 54 in side elements 26 and 28 may communicate with one or more holes 53 in the proximal end 33 of projection 16. The one or more holes 53 in projection 16 may communicate with internal passage 17 to supply an airflow to one or more openings 37. In one aspect, in order to minimize or prevent air leakage between adjacent air passages, some form of sealing elements or devices may be provided in or about holes 52 and/or 53 and/or 54. In one aspect, as shown in FIG. 6, one or more O-rings 58 may be provided as needed, for example, inserted into O-ring seats 59 (only one of which is shown in FIG. 6) in side elements 26 and/or 28. Other sealing means may also be used, and, in one aspect, no sealing means may be provided. Holes 52, 53, and 54 may have diameters ranging from about 0.125 inches to about 1 inch, depending, among other things, upon the size of elements 26 and 28 and projection 16. However, typically, holes 52, 53, and 54 may have a diameter ranging from about 0.125 inches to about 0.5 inches, for example, about 0.375 inches.

In one aspect of the invention, projection module 22 may include one or more means to automatedly detecting the positioning of projection 16 to, for example, initiate the flow of drying air through module 22 (as discussed with respect to FIGS. 7 and 8, below). For example, in one aspect, one or more sensors may be provided in or about assembly 22 to detect the positioning of projection 16. In one aspect, the positioning of projection 16 may be detected photometrically, for example, by means of the detection of the presence or absence of light upon a photo detector. In one aspect, as shown in FIGS. 5 and 6, through holes 60 may be provided in side elements 26 and/or 28 through which a light beam, for example, laser beam, may be passed (as indicated by dashed line 62 in FIG. 6). In one aspect, when projection 16 is deflected into the extended position, as shown in FIGS. 5 and 6, an unobstructed path for light beam 62 is provided between holes 60. This light beam 62 may then be detected by a photodetector (not shown), for example, a photodetector positioned in module 22, in an adjacent module 22, or as appropriate anywhere in apparel drying assembly 10. The photodetector may be adapted to emit an electrical signal when light or lack of light is detected, for example, emit an electrical signal via a controller, to initiate activation of the source of drying air flow, for example, to a fan assembly. Conversely, when projection 16 is retracted, as shown in FIG. 4, the path of light beam 62 may be interrupted and the operation of the source of airflow may be terminated or "shut off." Other means of initiating and terminating air flow with sensors, detectors, and/or linkages are also within the purview of the present invention.

Side elements 26 and 28 and internal element 30 may be assembled by any conventional means, for example, with mechanical fasteners, adhesives, and/or welding or brazing, for instance, when manufactured from metallic components.

Figure 7:
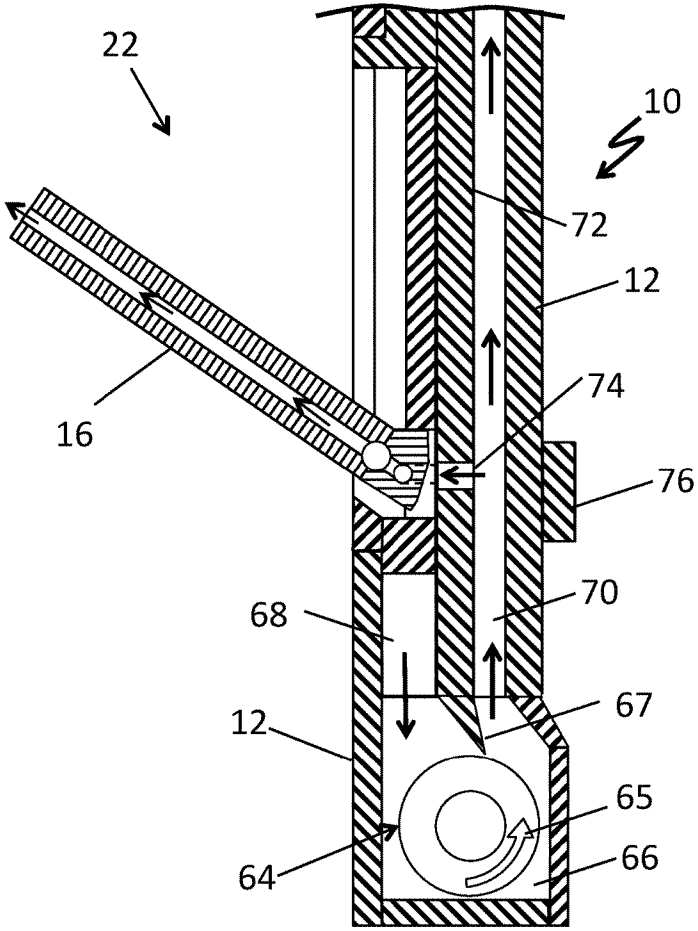
FIG. 7 is a cross sectional view of the apparel drying assembly shown in FIG. 2 as identified by Detail 7 shown in FIG. 2, with the projection in an extended position.

FIG. 7 is a detailed cross sectional view of apparel drying assembly to shown in FIGS. 1 and 2 as indicated by Detail 7 in FIG. 2, with projection 16 shown in an extended position. FIG. 8 is a detailed cross sectional view similar to FIG. 7, with projection 16 shown in a retracted position. In addition to illustrating panel 12 and projection module 22 with projection 16, FIGS. 7 and 8 also schematically illustrate the location in assembly 10 of fan assembly 64 according to one aspect of the invention. Though fan assembly 64 may be located anywhere convenient in assembly 10, in one aspect, for example, fan assembly 64 may be located in the bottom of panel 12 and direct a flow of air upward into panel 12, though other locations and directions of airflow for fan assembly 64 may be provided according to aspects of the invention. The rotation of fan assembly 64 is represented by arrow 65 in FIG. 7. In another aspect, fan assembly 64 may not be located within panel 12, but may be located adjacent to or remote from panel 12 and communicate with panel assembly 12 via one or more conduits or passageways as indicated by conduit 13 and/or 15 shown in FIG. 8 in phantom.

Fan assembly 64 may be any conventional fan assembly having the size and airflow output required to provide the desired drying function. Fan assembly 64 may typically have an airflow output of at least about 5 cubic feet per minute [$ft^3$/min] and at most about 400 $ft^3$/min, but typically ranges from about to $ft^3$/min to about too $ft^3$/min. In one aspect, fan assembly 64 may be a BK Squirrel Cage Blower Fan assembly provided by Smoky Mountain General Store [available at http://www.smgeneralstore.com/bk-blower-fan-bk.aspx], or its equivalent, though any appropriate conventional fan assembly may be used. Since fan assembly 64 is shown schematically in FIGS. 7 and 8, ancillary equipment typically provided with a fan assembly 64, such as, a power supply, a drive motor, electronic controls, anti-friction bearings, and mounting structures and hardware, are not illustrated in FIGS. 7 and 8, but are envisioned, as needed.

According to aspects of the invention, apparel-drying assembly 10 typically includes some form of cavity 66 sized, positioned, and appropriately sealed to retain fan assembly 64. As shown in FIG. 7, in one aspect, cavity 66 may be in fluid communication with one or more passages 68 within panel 12 adapted to communicate air, for example, ambient air, to cavity 66 and fan assembly 64. In one aspect, as shown in FIG. 1, one or more passages 68 may extend to the upper portion or top of panel 12, for instance, to draw warmer air from the top of a room having drying assembly 10 mounted therein. Also, cavity 66 may be in fluid communication with one or more passages 70 within panel 12 adapted to communicate pressurized air from fan assembly 64 to one or more projection modules 22, and ultimately to one or more projections 16. As also shown in FIGS. 7 and 8, cavity 66 may include one or more baffles 67 positioned to assist in promoting airflow from cavity 66 to passage 70. As shown in FIGS. 7 and 8, panel 12 may typically include at least one distribution plate or panel 72 having at least one perforation or hole 74, but typically, a plurality of perforations or holes 74, adapted to direct air from passage 70 to one or more projection modules 22. In one aspect, the interface between panel 72 and module 22 at or around holes 74 may be provided with a sealing device, for example, one or more O-rings (not shown) mounted in an O-ring seat.

Aspects of the invention may also provide one or more devices for heating and/or dehumidifying the airflow introduced to projections 16. For example, in one aspect, an internal or external heater or heat exchanger may be provided in panel 12 and/or adjacent to or remote from panel 12, for example, associated with conduit 13 or conduit 15. For instance, in one aspect, cavity 66 in panel 12 may be sized to contain fan assembly 64 and a heater (not shown). The heater may be a radiant heater (for example, an electric radiant heater or a hot water radiant heater), a hydronic heater, or an oil-, gas-, wood-, or pellet-fired heater. In one aspect, panel 12 may be in fluid communication with an existing heat source, for example, a residential forced-air furnace or a stove, such as, a wood stove, a pellet-burning stove, a propane heater, or a natural gas heater, among others. The one or more heat sources disclosed herein may be used to heat the air flow where the temperature of the air flowing from fan assembly 64 is at least 5 degrees F. above ambient air temperature, in one aspect, at least to degrees F. above ambient air temperature. For example, in one aspect, the temperature of the air emitted by projections 16 may range from about 50 degrees F. to about 150 degrees F., but is typically between about 90 degrees F. and about 120 degrees F.

Panel 12 may include a plurality of mounting bars or mounting elements 76 appropriately positioned and configured to mount assembly 10 a surface, for example, to a vertical wall.

According to aspects of the invention, with the activation of fan assembly 64, for example, via the detection of the deflection of projection 16 via a photodetector discussed herein, fan assembled 64 rotates in the direction of arrow 65 and provides a flow of air to one or more passages 70. Under the operation of fan assembly 64, air is drawn into cavity 66 from one or more intake passages 68, for example, drawn from one or more inlets in the top or upper portion of assembly 10. The pressurized air in passage 70 may typically range from about 0.01 to about 10 pounds per square inch-gauge (psig), but is typically between about 1 inch of water gauge [iwg] (that is, about 0.04 psig) and about 10 iwg (that is, about 0.40 psig). The flow of air within one or more passages 70 distributes pressurized air to one or more holes 74 in distribution panel 72 and to the one or more projection modules 22 and to projections 16. The flow of air into holes 74 may be enhanced by positioning one or more baffles 75 (shown in phantom in FIG. 8) shaped and positioned to direct or encourage airflow into holes 74.

Figure 8:
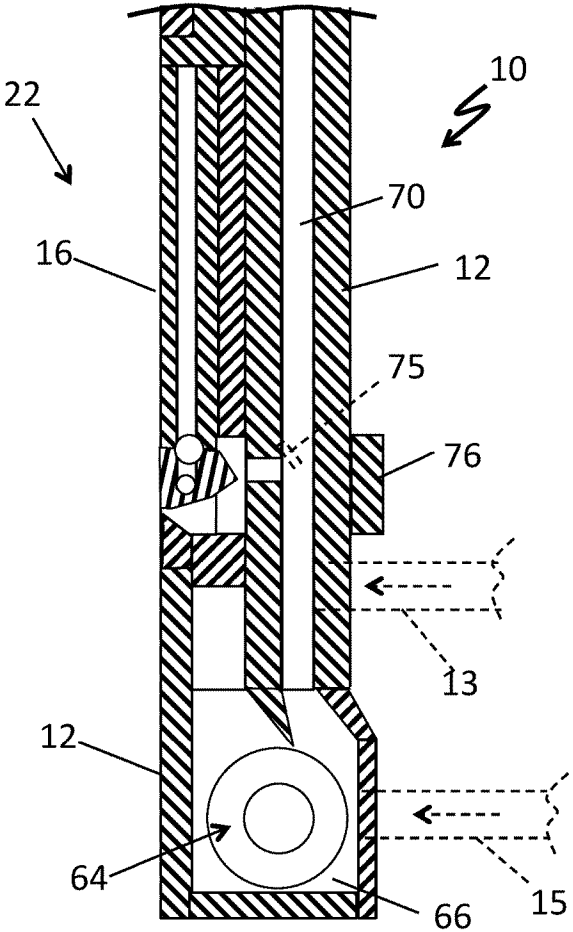
FIG. 8 is a cross sectional view, similar to FIG. 7, of the detail shown in FIG. 7, with the projection in a retracted position.

As shown in FIG. 8, when fan assembly 64 is not operating, projection 16 of projection module 22 may be retracted. When retracted, as shown in FIG. 8, projection 16 may be retained in the retracted position by conventional means, for example, with mechanical fasteners or biasing springs. In one aspect, projection 16 may be retained in the retracted position by friction, for example, friction between opposing surfaces and/or friction between a sealing device, such as, an O-ring, and an opposing surface. However, in one aspect, no mechanical device may be required to retain projection 16 in its retracted position shown in FIG. 8. In addition, when retracted, the position of projection 16 may be detected by one or more sensors, as disclosed herein, where fan assembly 64 is deactivated.

Figure 9:
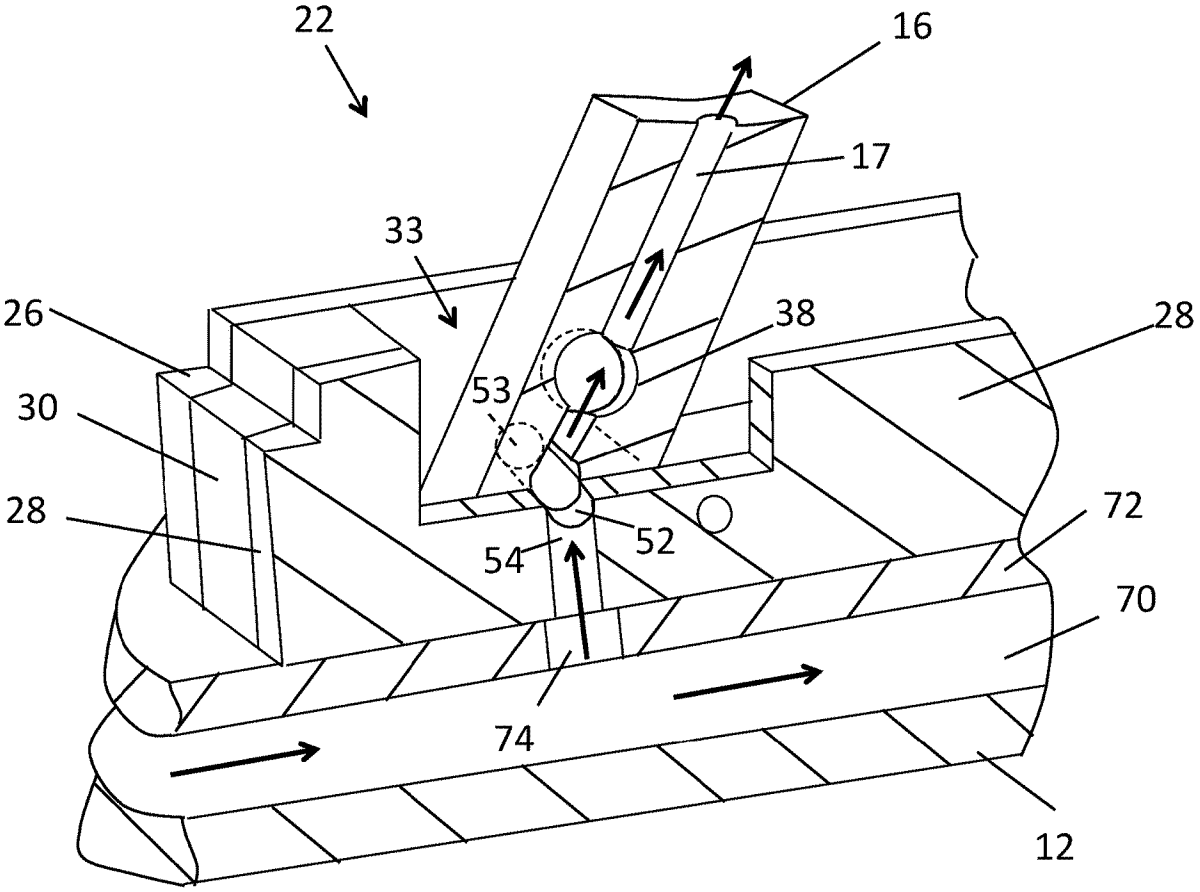
FIG. 9 is a perspective view, partially in cross section, of one set of air passages in the apparel drying assembly shown in FIGS. 1 and 2 according to one aspect of the invention.

FIG. 9 is a perspective view, partially in cross section, of one set of passages in apparel drying assembly 10 shown in FIGS. 1 and 2 according to one aspect of the invention. FIG. 9 includes portions of projection module 22, including projection 16, side elements 26 and 28, and internal element 30; a portion of panel 12; a portion of distribution panel 72 having at least one hole 74; and a portion of passage 70, as disclosed herein. As shown in FIG. 9, in one aspect, pressurized air introduced to passage 70 passes through one or more holes 74 in distribution panel 70 and is introduced to projection module 22, for example, to one of the through holes 54 of side element 28. As shown in FIG. 9, in one aspect, though holes 54 communicate with one or more holes 53 in the distal end 33 of projection 16. In the proximal end 33 of projection 16, holes 53 communicate with internal passage 17 of projection 16. Internal passage 17 may pass through hole 38 that contains pin 34 and, for example, coil spring 40 (not shown in FIG. 9). For example, in one aspect, pressurized air may flow passed pins 40 and through spring 40 en route through internal passage 70. According to aspects to the invention, internal passage 17 distributes the airflow to one or more holes or orifices in projection 16, for example, to one or more holes 37 at the distal end 35 of projection 16 (see FIGS. 5 and 6).

Figure 10:
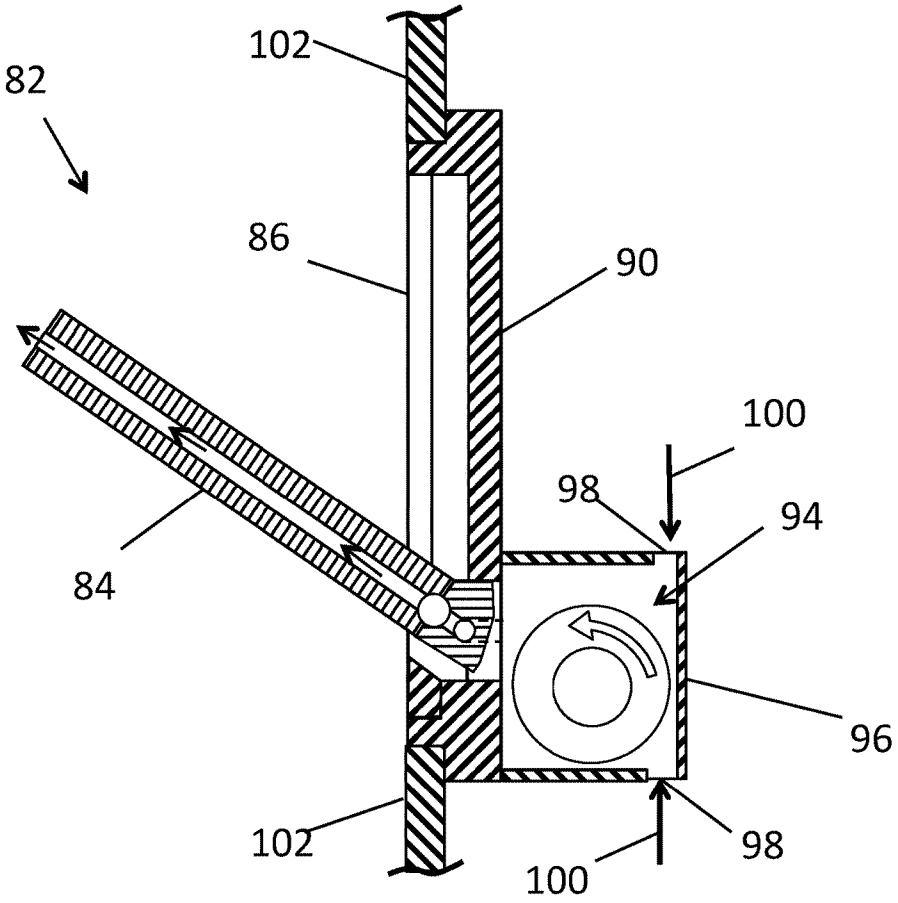
FIG. 10 is a cross sectional view, similar to FIGS. 7 and 8, of a projection module with a projection in an extended position according to another aspect of the invention.

FIG. 10 is a cross sectional view of a projection module 82 having a pivotally mounted projection 84 in an extended position according to another aspect of the invention. In a manner similar to projection module 22 disclosed herein, projection module 82 may typically include side elements 86 and 88 (not shown) and internal element 90. Otherwise module 82 may include all the features and functions of module 22. In the aspect of the invention shown in FIG. 10, projection module 82 may also include a source of pressurized air 94, for example, an electric fan, contained in a housing 96 mounted to, for example, side elements 86 and 88 and internal element 90. According to the aspect of the invention shown in FIG. 10, projection module 82 includes a dedicated source of pressurized air 94. Though in FIG. 10 source 94 comprises a squirrel-cage type fan or blower, any source of pressurized air may be used with aspects of the invention. Module 82 may also include a heat source adapted to heat the air propelled by the source of pressurized air 94.

As shown in FIG. 10, housing 96 for fan 94 may typically include one or more inlets or apertures 98 allowing air, for example, ambient air, to be drawn into housing 96, as indicated by arrows 100. The air drawn in by fan 96 is then expelled by fan 94 from housing 96 into projection 84, for example, as disclosed herein, to dry the piece of apparel (not shown) mounted on projection 84.

According to this aspect of the invention, module 82 having fan 94 may comprise a self-contained device for drying apparel. For example, as illustrated in FIG. 10, projection module 82 may be positioned or mounted in to a wall, surface, or a panel 102 and the pivotally mounted projection 84 may provide the drying function disclosed herein. Projection module 82 may be mounted to wall, surface, or panel 102 by conventional means, for example, with mechanical fasteners or an adhesive. For example, in one aspect, a plurality of modules 82 may be mounted into a wall, surface, or panel, such as, into panel 12 shown in FIG. 1. In one aspect, two modules 84 may be mounted in a closet or locker to dry footwear, such as, work boots, skates, sneakers, cleats, and the like; or hand wear, such as, gloves, mittens, and the like, as disclosed herein.

Figures 11, 12:
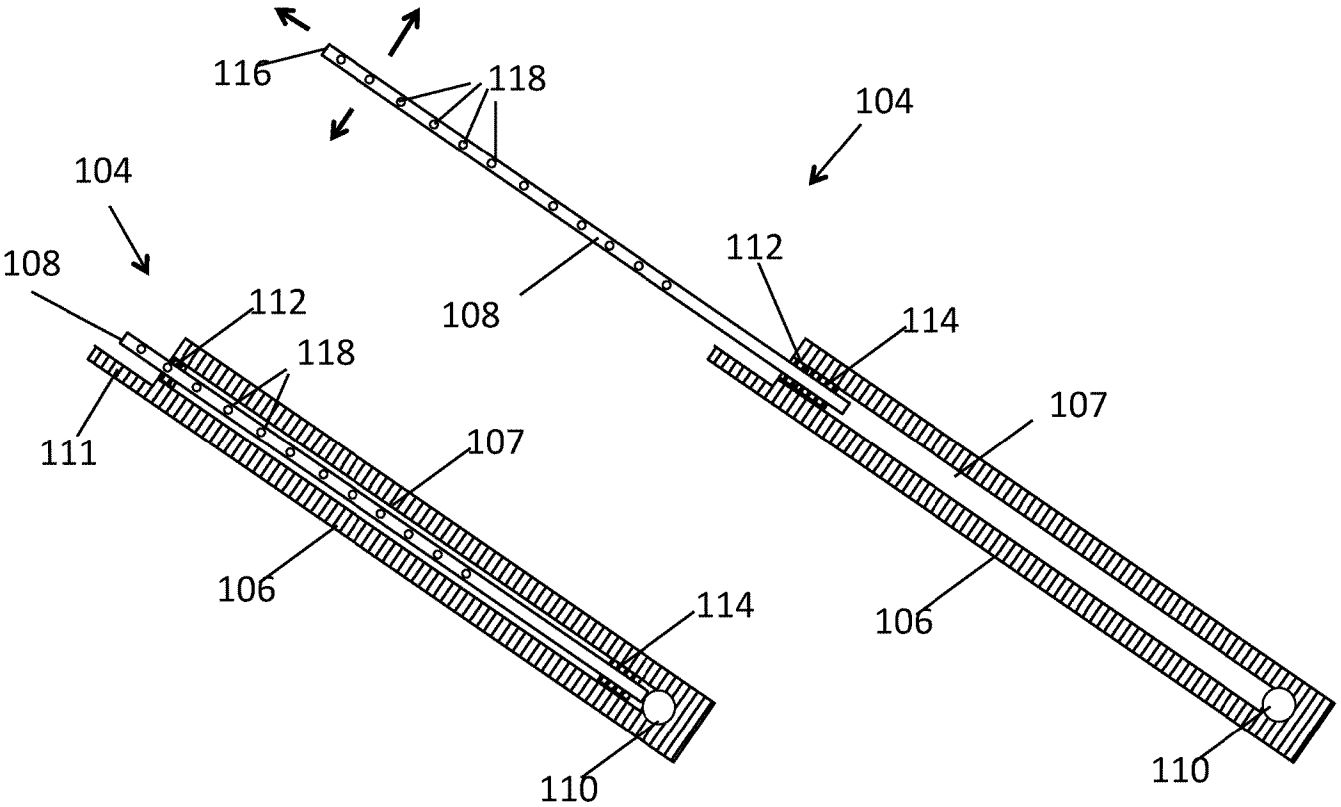
FIG. 11 is a cross sectional view of a projection having an extractable air distribution tube in a retracted position according to another aspect of the invention.
FIG. 12 is a cross-sectional view, similar to FIG. 11, of the projection shown in FIG. 11 having the extractable air distribution tube in a extracted position according to another aspect of the invention.

FIG. 11 is a cross-sectional view of a projection assembly 104 having a projection 106 and an extractable air distribution tube or hose 108 in a retracted position according to another aspect of the invention. As shown, in this aspect, projection 106 includes an internal passage 107 into which tube 108 can be slidably placed. In a manner similar to projection 16 disclosed herein, projection 106 may typically be pivotally mounted, and internal passage 107 is typically in fluid communication with a source of pressurized air, for example, via one or more holes 110 in the proximal end of projection 106. According to the aspect of the invention shown in FIG. 11, tube 108 is also in fluid communication with the source of pressurized air, and, when extracted (as shown in FIG. 8), tube 108 can be inserted into the apparel mounted on projection 106 to enhance the distribution of drying air into the apparel, for example, into the toe of a shoe, boot, or skate that requires drying. In the aspect shown in FIG. 10, projection 106 may include a lip or projection 111 adapted to conceal and/or protect an end of tube 108, which may protrude from internal passage 107, for example, to conceal tube 108 when projection 106 is in the pivotally retracted position. In other aspects, the lip 111 may be omitted.

In one aspect, projection 106 may be adapted to retain tube 108 in internal passage 107. For example, in one aspect, projection 106 may include an obstruction or restriction 112 adapted to engage and/or retain tube 108 in projection 106. In one aspect, tube 108 may include an annular projection or ring 114 positioned and sized to translate with tube 108 along internal passage 107 and contact obstruction 112 to prevent complete removal of tube 108 from projection 106. Other means of retaining tube 108 within projection 106 will be apparent to those of skill in the art.

FIG. 12 is a cross-sectional view, similar to FIG. 11, of the projection assembly 104 shown in FIG. 11 having the extractable air distribution tube 108 in an extracted position according to another aspect of the invention. As shown in FIG. 12, with the partial extraction of tube 108, ring 114 may contact restriction 112 and limit or prevent the total extraction of tube 108, for example, to prevent removal.

Tube 108 may comprise a hollow conduit, for example, a hollow flexible conduit, having at least one axial hole 116 at its end, and may have a plurality of radially directed holes 118 adapted to direct air radially from tube 108. Tube 108 may be made from a plastic or elastomeric material. In one aspect, tube 108 may have an outside diameter ranging from about 0.0625 inches to about 0.50 inches, but typically has an outside diameter ranging from about 0.125 to about 0.25 inches. Tube 108 may have an inside diameter ranging from about 0.0325 to about 0.375 inches, but typically has an inside diameter ranging from about 0.1625 to about 0.125 inches. Radial holes 118 may be uniformly distributed along tube 108 and may have diameters ranging from about 0.0325 inches to about 0.375 inches, but typically having a diameters ranging from about 0.1625 to about 0.125 inches.

FIG. 13 is an exploded perspective view of a portion of a side element 26 of projection assembly 22 and a pin 34 shown in FIGS. 5 and 6 according to one aspect of the invention. As shown, side element 26 includes a blind hole 36 sized and positioned to receive pin 34. As illustrated in FIG. 6, pin 34 may be biased into position in blind hole 36 by, for example, coil spring 40. According to this aspect of the invention, the geometry of blind hole 36 may be adapted whereby projection 16 may be more readily pivotally mounted to side elements 26 and 28, and disengaged from side elements 26 and 28, for example, for assembly, servicing, or maintenance of projection assembly 22. According to aspects of the invention, side element 28 (not shown) may comprise a mirror image of side element 26 shown in FIG. 13 and include a blind hole 36 having substantially identical adaptations to enhance mounting and disengagement.

FIG. 14 is a plan view of the portion of the side element 26 shown in FIG. 13. As shown, in this aspect, blind hole 36 in side element 26 is adapted to engage and disengage pin 34 (not shown in FIG. 14). Accordingly, in one aspect, the blind hole 36 includes a ramp or tapered recess 120 adapted to allow engagement and/or disengagement of pin 34 with side element 26. The angle of orientation, $\alpha$, of ramp 120 is chosen where the projection 16 (not shown in FIG. 14) and pin 34 can be removed or disengaged from side element 26 (for example, when projection 16 is not loaded by an apparel, such as, a boot), but where side element 26 will retain projection 16 and pin 34 when projection 16 is loaded, for example, with a boot. In one aspect, the angle of orientation $\alpha$ may range from about 20 degrees to about 70 degrees, but is typically between about 20 degrees and about 40 degrees, for example, about 30 degrees. The width 124 of ramp 120 may typically be about the diameter of blind hole 36, for example, the width 124 may range from about 0.25 inches to about 2 inches, but is typically between about 0.5 inches and 1 inch, for example, about 0.625 inches.

FIG. 15 is a cross sectional view of the portion of side element 26 shown in FIG. 14 as viewed along section lines 15-15 in FIG. 14. Pin 34 is shown in phantom in FIG. 15 for reference. As shown most clearly in FIG. 15, ramp 120 tapers at an angle $\beta$ from the bottom or base of blind hole 36 to the surface 122 of side element 26. In one aspect, as shown in FIG. 15, ramp 120 may intersect the surface 122 at an edge of side element 26; however, in another aspect, ramp 120 may intersect surface 122 at a location interior of an edge. The angle $\beta$ of ramp 120 may range from about 0.5 degrees to about 30 degrees, but is typically between about 10 degrees and 20 degrees, for example, about 17 degrees.

As shown in FIG. 15, blind hole 36 may have a depth 126 and a diameter 128. Depth 126 may range from about 0.03125 inches to about 1 inch, but is typically between about 0.0625 inches to about 0.25 inches, for example, about 0.125 inches. Diameter 128 of blind hole 36 may range from about 0.25 inches to about 2 inches, but is typically between about 0.5 inches and about 1 inch, for example, about 0.625 inches.

FIG. 16 is a cross sectional view, similar to FIG. 15, of the portion of the side element 26 shown in FIG. 15 showing the relative movement of mounting pin 34 according to one aspect. In order to aid in the disclosure of this aspect, a representative portion of projection 16, pins 34, and biasing spring 40 are also shown in phantom in FIG. 16. In one aspect, as projection 16 is disengaged from side element 26 (and from side element 28, not shown) as indicated by the direction of arrow 130, under the influence of spring 40, pin 34 engages blind hole 36 and is displaced from blind hole 36 and slidably engages ramp 120. Further movement of projection 16 in the direction of arrow 130 further displaces pin 34 along ramp 120 until pin 34 disengages ramp 120 and projection 16 with pins 34 disengages side element 26 (and side element 28). In a similar fashion, projection 16 and pins 34 can engage side element 26 (and side element 28) by reversing the movement indicated by arrow 130 until pins 34 re-engage blind hole 36.

According to aspects of the invention, the disengagement and engagement (or re-engagement) of projection 16 from side elements 26 and 28 may allow projection 16 and projection module 22 (and any projection module disclosed herein) to be serviced, maintained, or replaced. In addition, ready removal and re-engagement of projection 16 with side elements 26 and 28 can allow access to other components of the invention, for example, to distribution panel 72 (see FIG. 7), to mounting elements 76 (see FIG. 7) and fasteners associated with mounting elements 76, fan assembly 94 (see FIG. 10), spring 40, and pins 34, among other components.

As disclosed herein, embodiments of the invention, in their many aspects, provide systems, devices, and methods for introducing a stream of drying air to articles, for example, articles of clothing, for instance, foot wear (for example, ski boots, snowboard boots, shoes, boots, work boots, sneakers, skates, cleats, soccer boots, socks, and the like); hand wear (for example, gloves, work gloves, ski gloves, hockey gloves, mittens, and the like); over coats (for example, ski wear, parkas, jackets, leg wear (for example, pants, ski pants, trousers, and the like); and other clothes or garments to dry the article and, for example, facilitate further use. Aspects of the invention may be adapted for use in firehouses, for example, to dry firemen's boots. Aspects of the invention may also be adapted for use by athletes, for example, in locker rooms, for instance, hockey locker rooms, for drying hockey gloves, hockey skates, and other gear, or in football locker rooms to dry footwear, helmets, and other gear. Aspects of the invention may be uniquely adapted to drying winter clothing, in particular, after a day on the skiing or sledding, but other aspects of the invention may be used for drying any form of clothing, including damp swim wear and beach towels. In addition to residential or resort use, aspects of the invention may also be used in commercial and/or industrial applications where the drying of articles, for example, fabrics, work gear, or manufactured articles is desired.

The terminology used herein is for the purpose of describing particular embodiments only and is not intended to be limiting of the disclosure. As used herein, the singular forms "a," "an," and "the" are intended to include the plural forms as well, unless the context dearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. An apparel drying assembly comprising:

a vertically oriented panel having an internal passage;

a plurality of projections, each of the plurality of projections pivotally mounted to the vertically oriented panel, having an inlet in fluid communication with the internal passage of the panel, at least one outlet, an internal passage communicating the inlet to the at least one outlet, and oriented in to at least one position adapted to receive an apparel; and a source of pressurized air having an outlet in fluid communication with the internal passage of the panel;

wherein the pressurized air passes through the internal passage of the panel, into each inlet, through each internal passage, and out each of the at least one outlet to contact and at least partially dry the apparel received by at least one of the plurality of projections; and wherein each of the pivotally mounted projections comprises a retracted position, wherein in the retracted position, a surface of each of the plurality of projections is substantially coplanar with a surface of the vertically oriented panel.

2. The drying assembly as recited in claim 1, wherein the drying assembly further comprises a projection module mounted to the vertically oriented panel, the projection module having at least one of the plurality of projections.

3. The drying assembly as recited in claim 2, wherein the projection module comprises a plurality of passages, the passages having an inlet in fluid communication with the outlet of the source of pressurized air.

4. The drying assembly as recited in claim 1, wherein each of the pivotally mounted plurality of projections is pivotally mounted to the vertically oriented panel with a pin.

5. The drying assembly as recited in claim 4, wherein the pin is biased into engagement with each of the pivotally mounted plurality of projections.

6. The drying assembly as recited in claim 1, wherein the assembly is substantially completely made of wood.

7. A method of drying apparel, the method comprising:

pivotally mounting a plurality of projections to a vertically oriented panel having an internal passage, each of the plurality of projections having an inlet, at least one outlet, and an internal passage communicating the inlet to the at least one outlet;

rotating each of the pivotally mounted projections from a retracted position wherein a surface of each of the plurality of pivotally mounted projections is substantially coplanar with a surface of the vertically oriented panel, to an extended position;

providing a source of pressurized air having an outlet operatively connected to the internal passage of the vertically oriented panel;

mounting an apparel on to some of the plurality of projections in the extended position;

passing the pressurized air to each of the inlets of the plurality of projections, through the internal passages, and out of each of the at least one outlet; and contacting the air discharged from the at least one outlet of the plurality of projections upon the apparel to at least partially dry the apparel.

8. The method as recited in claim 7, wherein pivotally mounting the plurality of projections to the vertically oriented panel comprises mounting a projection module to the vertically oriented panel, wherein one of the plurality of projections is pivotally mounted to the projection module.

9. The method as recited in claim 7, wherein the method further comprises heating the pressurized air.

10. The method as recited in claim 7, wherein the apparel comprises at least one of footwear and hand wear.

11. An apparel drying projection module adapted to be mounted in a panel having a passage for pressurized air, the module comprising:

a housing mountable in the panel; and a projection pivotally mounted to the housing, the projection having an inlet adapted to receive pressurized air from the passage in the panel, at least one outlet, an internal passage communicating the inlet to the at least one outlet, and wherein the pivotally mounted projection is adapted to be oriented in to at least one position extended from the housing to receive an apparel;

wherein the pivotally mounted projection is further adapted to be pivotally rotated into a retracted position wherein a surface of the pivotally mounted projection is substantially coplanar with a surface of the housing.

12. The projection module as recited in claim 11, wherein the housing comprises passages in fluid communication with the inlet of the projection and in fluid communication with a source of pressurized air.

13. The projection module as recited in claim 11, wherein the module is substantially completely made of wood.

14. The drying assembly as recited in claim 1, wherein the plurality of projections is biased into the retracted position.

15. The drying assembly as recited in claim 14, wherein the plurality of biased projections is biased by a biasing spring.

16. The drying assembly as recited in claim 1, wherein the surface of the pivotally mounted projection comprises an exposed surface of the pivotally mounted projection, and wherein the surface of the housing comprises an exposed surface of the housing.

17. The drying assembly as recited in claim 1, wherein the assembly further comprises an air distribution tube extending from at least one of the plurality of projections.

18. The drying assembly as recited in claim 17, wherein the air distribution tube comprises an extractable air distribution tube.

19. The drying assembly as recited in claim 17, wherein the air distribution tube comprises a plurality of radially directed holes.

* * * * *